US006253471B1

(12) United States Patent
Strauh

(10) Patent No.: US 6,253,471 B1
(45) Date of Patent: Jul. 3, 2001

(54) CANVAS STRETCHING AND FRAMING DEVICE

(76) Inventor: Craig H. Strauh, 1516 W. Jackson, Springfield, IL (US) 62704

( * ) Notice: Subject to any disclaimer, the term of this patent is extended or adjusted under 35 U.S.C. 154(b) by 0 days.

(21) Appl. No.: 09/349,525

(22) Filed: Jul. 8, 1999

(51) Int. Cl.[7] ..... D06C 3/08
(52) U.S. Cl. ..... 38/102.1; 160/381
(58) Field of Search ..... 38/102.1, 102.4, 38/102.7, 102.91; 160/374.1, 381, 379

(56) References Cited

U.S. PATENT DOCUMENTS

| | | | | |
|---|---|---|---|---|
| 1,852,866 | * | 4/1932 | Weitzel | 160/381 |
| 3,211,089 | | 10/1965 | Messerschmitt | 101/127.1 |
| 3,422,554 | * | 1/1969 | Prinzhorn | 38/102.1 |
| 3,482,343 | * | 12/1969 | Hamu | 38/102.91 X |
| 4,018,260 | | 4/1977 | Baslow | 160/327 |
| 4,050,498 | | 9/1977 | Lucchetti | 160/374.1 |
| 4,144,660 | | 3/1979 | Lamb | 38/102.5 |
| 4,179,830 | | 12/1979 | Lamb | 38/102.5 |
| 4,195,681 | * | 4/1980 | Douglas et al. | 160/381 |
| 5,076,162 | | 12/1991 | Goin | 101/127.1 |

* cited by examiner

*Primary Examiner*—Ismael Izaguirre
(74) *Attorney, Agent, or Firm*—Roper & Quigg

(57) ABSTRACT

A canvas stretching and framing device upon which canvas or other sheet material may be stretched includes fixed corner sections and straight sections. The fixed corner sections ensure the squareness and rigidity of the device while simultaneously allowing for easy adjustments in order to maintain the canvas in a taut condition over the device. The straight sections may be easily cut to any desired length, which allows for easy adjustment of the device's size. The corner sections may include a plurality of protrusions which engage a plurality of cavities formed in the straight sections in a way that forms a continuous perimeter upon which canvas may be stretched.

8 Claims, 4 Drawing Sheets

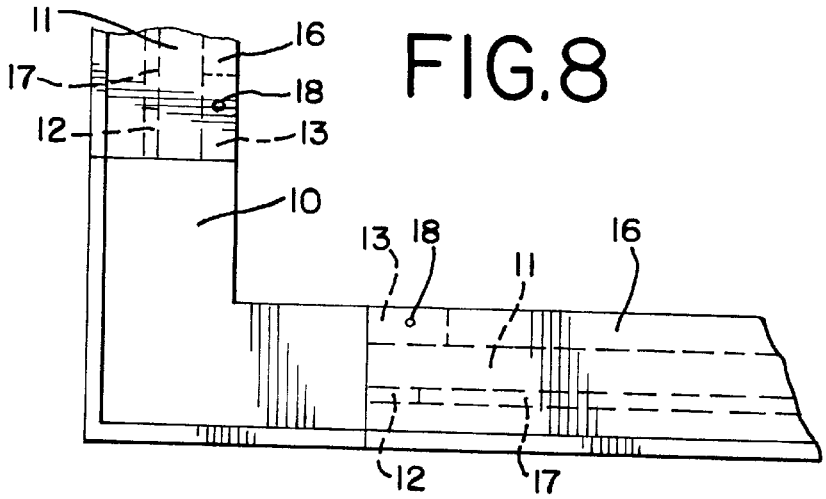
FIG.8
FIG.9
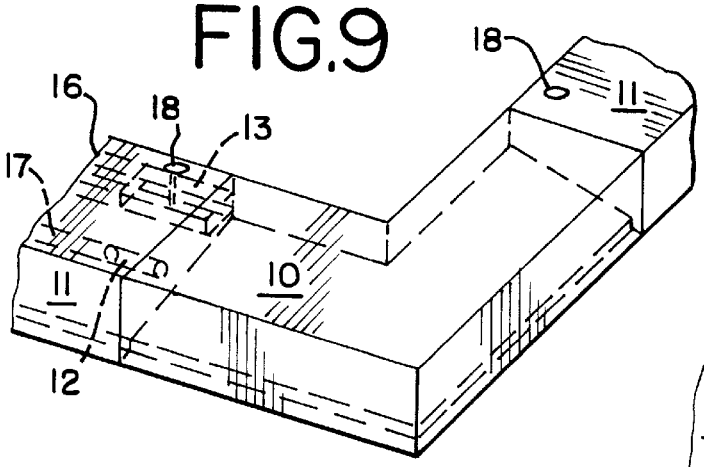
FIG.10
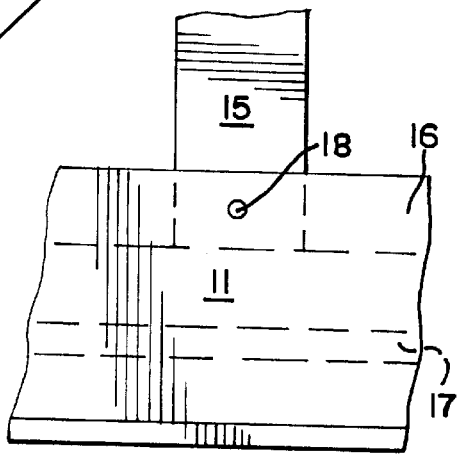
FIG.11
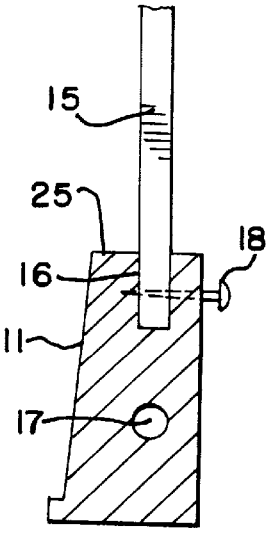
FIG.12
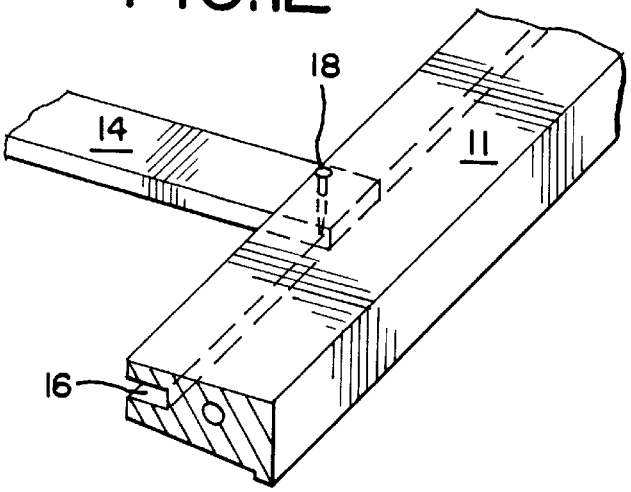

CANVAS STRETCHING AND FRAMING DEVICE

BACKGROUND OF THE INVENTION

1. Field of the Invention

The present invention relates to a canvas stretching and framing device upon which canvas or other sheet material may be stretched. Particularly, this invention relates to a unique canvas stretcher and framing device having fixed, square comers and easily adjustable straight sections.

2. Brief Description of Prior Art

As is well-known in the art, oil paintings on canvas are conventionally mounted on wooden frames which are sometimes referred to as canvas stretchers. The canvas stretcher as known in the prior art is assembled with interlocking comers which form a miter joint between the straight sections of the canvas stretcher. The canvas is affixed to one edge of the canvas stretcher using staples or nails, draped over the opposite side of the frame, manually stretched taught, and stapled or nailed to the frame. During this process, a certain amount of force is applied to the canvas stretcher which can result in the miter comers shifting out of a square orientation.

These traditional miter comers also have the disadvantage of complicating any desired changes in the size of the frame. In order to change the size of the frame, the artist must be familiar with certain sophisticated woodworking techniques and have the necessary equipment to create a miter joint.

In the past, a number of adjustable frames have been disclosed. Three examples of such frames are U.S. Pat. Nos. 4,050,498, 4,179,830 and 4,144,660, all of which have been improved upon by the instant invention. The adjustable frames disclosed by the patents noted above are very complex from a mechanical standpoint and thus are difficult and expensive to manufacture. For example, U.S. Pat. No. 4,179,830 discloses corner segments which are made up of no less than five separate parts and include moving parts. U.S. Pat. No. 4,144,660 similarly has corner segments involving multiple elements including moving parts. U.S. Pat. No. 4,050,498 discloses a frame device having corner sections comprised of not less than four discrete parts including a spring-like "adjusting element."

Known adjustable frames also require that the straight sections of the frame have 45° mitered ends. This limits the ease with which these straight sections can be cut down and reduced in length. Creating a mitered corner requires a certain advanced knowledge of woodworking techniques and equipment. Also, commercially available canvas stretchers ordinarily have 45° mitered comers with one or more projecting legs, and respectively one or more recesses which join with the adjacent frame member. This complicated joinery further limits the ease with which the size of the frame may be altered or resized.

A further problem with presently known and currently available canvas stretching devices is that they are not designed in such a way that they may effectively and simply adjust for any expansion or contraction of the canvas due to changes in environmental conditions. Commercially available canvas stretching devices attempt to alleviate this problem by requiring the insertion of spacers into each of the mitered comers in a way that expands the joints. Construction of mitered comers in a way that allows for adjustment in this fashion is complex. Both construction and use of this kind of stretching mechanism requires several working steps.

Canvas stretched upon a canvas stretcher, moreover, exerts inward force on the perimeter of the canvas stretcher which can result in distortions of the canvas stretcher. The constant inward force exerted by the canvas can cause the perimeter of the canvas stretcher to warp and bow toward the center of the canvas. In order to avoid this, braces are often placed across the back of the canvas stretcher. These braces are ordinarily tacked onto the back of the stretcher resulting in a painting which cannot be hung flush against a wall as a result of the protruding braces.

A further problem facing commercially available canvas stretchers is the deterioration of a painting that occurs with age. It has been found that canvas paintings deteriorate at the point of contact of the canvas with the frame. It is believed that this damage is due to the reaction of the paint on the canvas with the wood material of the canvas stretcher itself caused by the resins and acids in the wood.

SUMMARY OF THE INVENTION

It is a general object of the present invention to provide a canvas stretcher that overcomes the above-noted deficiencies.

It is a still further object of this invention to provide a canvas stretcher with fixed comers which maintain the canvas stretcher's squareness while allowing for easy adjustments in order to maintain the canvas in a taut condition over the frame.

It is another object of this invention to provide a canvas stretcher the size of which may be adjusted easily without the use of expensive tools or without knowledge of advanced or sophisticated woodworking techniques.

It is still a further object of this invention to provide a canvas stretcher which decreases the likelihood of canvas deterioration as a result of contact with the canvas stretcher by decreasing the surface area of the canvas stretcher which is in contact with the canvas.

Finally, it is a goal of this invention to provide a canvas stretcher with optional bracing members to prevent warping of the canvas stretcher as a result of the tension placed on the canvas stretcher by the canvas which do not protrude beyond the rear of the canvas stretcher itself. The optional bracing members define a plane which is internal to the rear plane of the canvas stretcher.

BRIEF DESCRIPTION OF THE DRAWINGS

For a more complete understanding of this invention, reference now should be made to the embodiment illustrated is greater detail in the accompanying drawings and described by way of example only. In the drawings:

FIG. 8 is a detail front view drawing of the fixed corner sections and straight sections as they would be joined together in one embodiment of the invention.

FIG. 9 is a detail perspective drawing of the fixed corner sections and straight sections as they would be joined together in one embodiment of the invention.

FIG. 10 is a front view of the straight sections and the bracing members joined together in one embodiment of the invention.

FIG. 11 is a cross-sectional view of the straight sections and the bracing members joined together in one embodiment of the invention.

FIG. 12 is a perspective view of the straight sections and the bracing members joined together in one embodiment of the invention.

DETAILED DESCRIPTION

Figure 1:
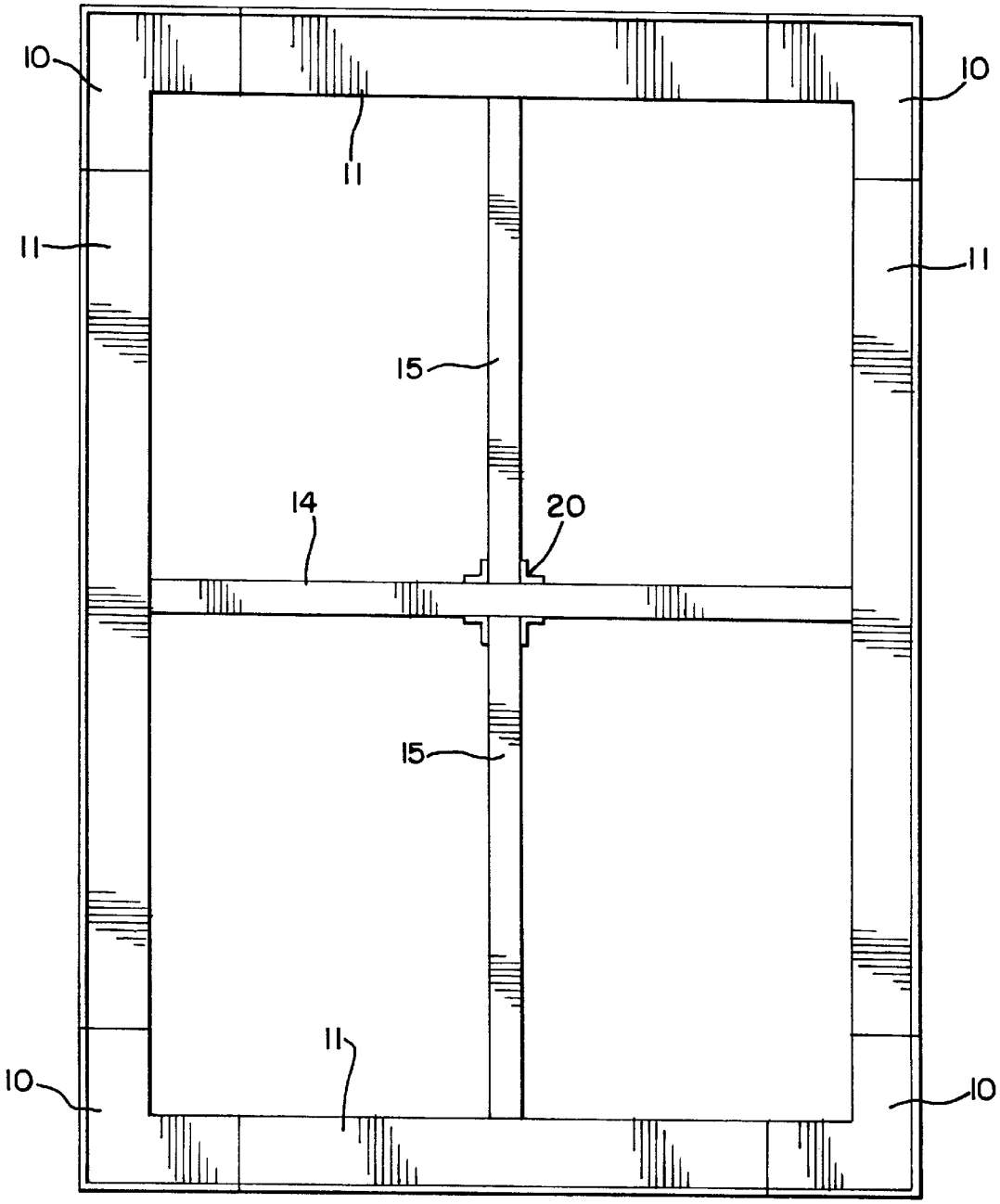
FIG. 1 is a front elevation of one embodiment of the invention with the fixed corner sections, straight sections, and long and butting bracing members all joined together.
Figure 13:
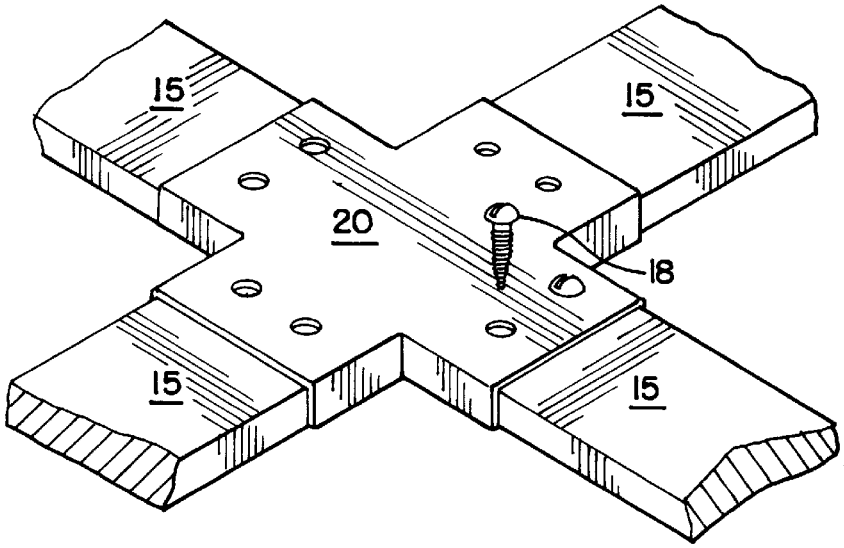
FIG. 13 shows the intersection of the bracing members at the back of the frame including a cross bracing member which provides support at their intersection in one embodiment of the invention.

With reference to the drawings, and initially to FIG. 1, it can be seen how the fixed corner sections 10 join with the straight sections 11 in a way that ensures the squareness of the canvas stretcher's structure. It can also be seen that the optional long and butting bracing members 14 and 15, respectively, are transverse to each other across the back of the canvas stretcher and that their intersection is supported by a cross bracing member 20. The long bracing member 14 covers the length or width of the canvas stretcher in a single span. The other butting bracing member 15 spans about half of the canvas stretcher's length or width and butts against the long bracing member 14. As seen in FIG. 13, an alternative embodiment of this invention has four butting bracing members 15 whose intersection is supported by a cross bracing member 20.

Figure 2:
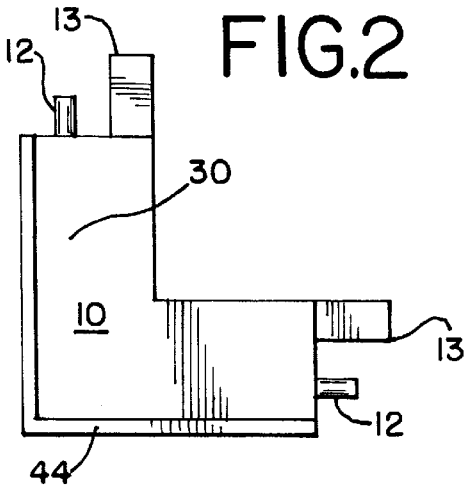
FIG. 2 is a front elevation of the fixed corner sections of one embodiment of the invention.
Figure 3:
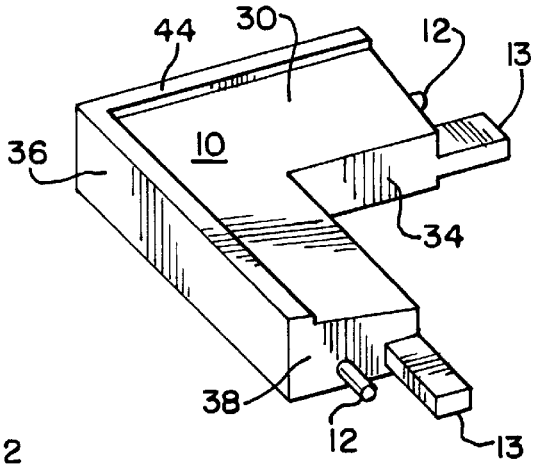
FIG. 3 is a perspective view of the fixed corner section of one embodiment of the invention.
Figure 4:
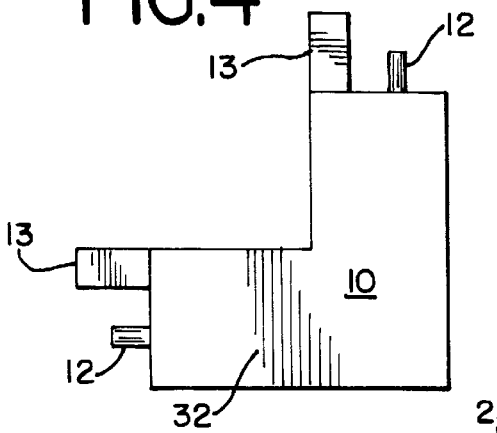
FIG. 4 is a rear elevation of the fixed corner section of one embodiment of the invention.

FIGS. 2, 3, and 4 are detail drawings of the fixed corner sections 10. The fixed corner sections 10 have a fixed corner upper surface 30, a fixed corner lower surface 32, a fixed corner interior surface 34 and a fixed corner exterior surface 36. The fixed corner sections also have two fixed corner end surfaces 38. This invention comprises a plurality of protrusions extending from at least one of the fixed corner end surfaces 38. FIG. 3 shows an embodiment having a circular dowel 12 and a rectangular peg or tenon 13 which are formed on each fixed corner end surface 38 of the fixed corner section 10 configured in a way to frictionally join with the straight section 11. The fixed nature of the fixed corner section 10 is also illustrated in FIGS. 2 and 4. FIGS. 2 and 4 show that the corner need not be formed by joining a number of structural elements. Rather, it can be formed in essentially a single piece construction, and can be made from, for example, a molded or extruded material such as plastic, although it can also be formed from a natural material such as wood.

The fixed corner sections 10 are also formed with a fixed corner raised surface 44 formed on the fixed corner upper surface 30 near the fixed corner exterior surface 36. The fixed corner upper surface 30 slopes down towards the interior edge such that the fixed corner interior surface 34 is thinner than the fixed corner exterior surface 36.

Figure 6:
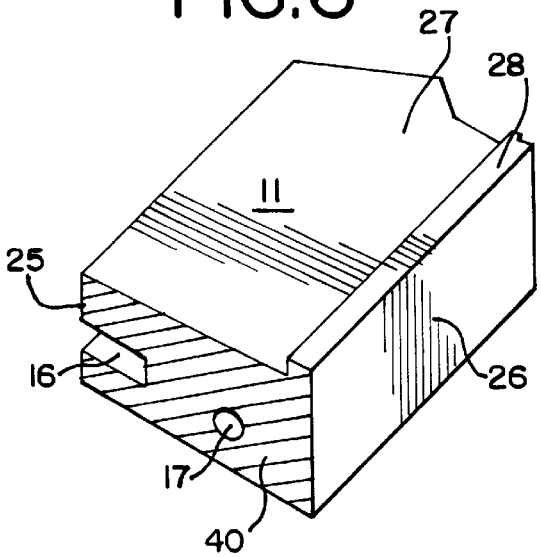
FIG. 6 is a perspective view of the straight sections of one embodiment of the invention.
Figure 5:
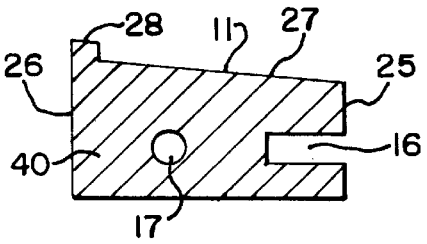
FIG. 5 is a cross-sectional view of the straight sections of one embodiment of the invention.
Figure 7:
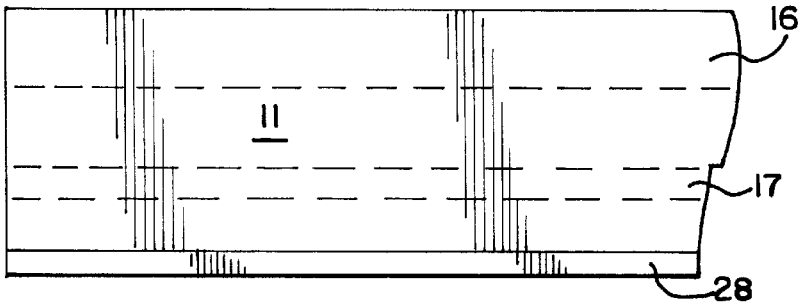
FIG. 7 is a front elevation of the straight sections of one embodiment of the invention.

FIGS. 5 and 6 show the straight section 11 having a straight section interior surface 25, a straight section exterior surface 26, and two straight section end surfaces 40. The embodiment shown in FIGS. 5 and 6 also shows a plurality of cavities located on at least one of said straight section end surfaces 40. This embodiment exhibits a circular aperture 17 formed in the straight section end surfaces 40 configured to accept the circular dowel 12. The straight section 11 also has a notch or mortise 16 formed into the straight section interior surface 25. The straight section 11 is also formed with a straight section upper surface 27 having a straight section raised surface 28 near the straight section exterior surface 26 and slopes down towards the interior edge such that the straight section interior surface 25 is thinner than the straight section exterior surface 26. FIG. 7 shows that the circular aperture 17 and notch 16 are formed throughout and along the entire length of the straight section 11, respectively.

FIGS. 8 and 9 show how the fixed corner section 10 and straight section 11 are joined together. The rectangular peg or tenon 13 is received into the notch or mortise 16 formed on the straight sections 11 and the circular dowel 12 is received into the circular aperture 17 formed in the straight section 11. FIGS. 8 and 9 also show a fastener 18 which may be driven through the straight section 11 in a way which fixes it to the rectangular peg 13 of the fixed corner section 10. The fastener may take the form of fastening devices known in the art, such as nails, screws, staples, or other known fasteners.

FIGS. 10, 11, and 12 show how the optional long and butting bracing members 14, 15 may be joined with the notch 16 formed in the straight sections 11, by simply frictionally fitting them into the notch 16 in the straight section. These figures also show a fastener 18 which may be driven through the straight section 11 in a way which fixes the optional long and butting bracing members 14, 15 to the straight sections 11.

Finally, FIG. 13 shows the intersection of the optional long and butting bracing members 14, 15. FIG. 13 shows an embodiment of the invention utilizing four butting bracing members 15. As shown in FIG. 1, an alternative embodiment has both a long bracing member 14 and two butting bracing members 15. In either embodiment, the intersection of the optional long and butting bracing members 14, 15 is supported by a cross bracing member 20 which is affixed to the optional long and butting bracing members 14, 15 with one or more fasteners 18. The optional bracing members 14, 15 are provided to enhance the overall strength of the stretcher and to prevent, for example, warping of the straight sections 11 of the canvas stretcher resulting from the stress applied by a taut canvas.

In the embodiment illustrated in FIGS. 8 and 9, the straight sections 11 and fixed corner sections 10 are adjustably butted together such that one or more fastening devices 18 could be utilized and removed. The straight section 11 may be adjusted by simply removing fastening device 18, and by moving along the circular dowel 12 and rectangular peg 13 and refastening by replacing the fastening device 18. This procedure provides a mechanism by which the canvas stretcher may adjust for any expansion of the canvas due to environmental conditions.

In U.S. Pat. Nos. 4,179,830, and 4,144,660, canvas stretching devices with adjustable corners are disclosed. However, these patents disclose multiple piece construction with complicated and heavy mechanical joinery involving nuts, threaded bolts and rods, and internally threaded grooves used to adjust the canvas stretcher. The instant invention provides an adjustable canvas stretcher with a mechanically simple, lightweight, and relatively inexpensive means to adjust the tension on the canvas. As described above, the present invention may be adjusted by merely altering the position of the straight section 11 on the rectangular peg 13 and circular dowel 12 formed on the fixed corner section 10 and reattaching fastening device 18.

A particularly unique and advantageous aspect of the present invention is the design of the fixed corner sections 10. As can be seen in FIGS. 2, 3 and 4, the fixed corner sections 10 are not comprised of two members which join together at a 45° joint as in commercially available canvas stretchers. This type of joint is susceptible to moving out of square during the canvas stretching process. The one piece fixed corner sections 10 of the instant invention are not susceptible to this problem. When stretching canvas over the canvas stretcher, the canvas is draped over the canvas stretcher, stapled, tacked, or otherwise attached along one edge, pulled taut, and affixed to the other edges of the canvas stretcher. This process requires the application of a significant amount of force to the canvas stretcher. Comer sections composed of multiple pieces are likely to shift during this process resulting in a final product which is not square. The fixed corner sections 10 of this invention are of one piece construction which give them the strength and rigidity to remain in a square orientation and reduce torsional stress which ensures the squareness and non-warping of the frame.

Two other important elements of this invention are the rectangular peg 13 and circular dowel 12 formed on each fixed corner end surface 38 of the fixed corner section 10 shown in FIG. 3. The circular dowel 12 is configured to provide for the proper alignment of the straight section 11 and fixed corner section 10. The rectangular peg 13 also provides for proper alignment of the straight section 11 with the fixed corner section 10. The rectangular peg 13 has the additional purpose of preventing any torsional movement of the straight section 11.

Another unique and advantageous aspect of the instant invention is the ease with which the size of the canvas stretcher may be adjusted. As shown in FIGS. 6 and 7, the notch 16 and circular aperture 17 configured to receive the rectangular peg 13 and circular dowel 12, respectively, are formed preferably continuously along either the entire length of the straight section 11, or a substantial portion of that section. This allows the artist to merely make a simple straight cut, using, for example, an ordinary saw, across the straight section 11 in order to alter its length and accordingly alter the size of the canvas stretcher. This operation may be performed simply and requires no knowledge of sophisticated woodworking techniques. The fact that the notch 16 and the circular aperture 17 are formed along and throughout the entire length, or a substantial length, of the straight section 11 means that the straight cut will expose a similar cross-section of the straight section 11, having a similar notch 16 and circular aperture 17 receptive to rectangular peg 13 and circular dowel 12, allowing a virtually unlimited amount of flexibility as to the size and shape of the canvas stretcher disclosed here. Every cut of a straight section yields the notch 16 and circular aperture 17 configured in a manner to join with the rectangular peg 13 and circular dowel 12 of the fixed corner sections 10.

Also, by providing a means to adjust the size of the canvas stretcher with a simple straight cut, this invention is less wasteful than commercially available canvas stretchers. Creating a mitered 45° joint requires that extra material be cut away to form the joint that need not be removed from the straight sections 11 in the current invention. This is particularly advantageous considering the cost of materials as well as environmental concerns.

This simplified process is a drastic contrast to the complicated means that are available for altering the size of commercially available canvas stretchers. The comers of commercially available stretchers have sophisticated mitered joints or involve heavy, mechanically complex systems with multiple components. U.S. Pat. Nos. 4,179,830, 4,144,600, and 4,050,498 disclose canvas stretchers with multiple piece corner construction and/or canvas stretching frames made out of numerous components joined together by complicated mechanical means involving nuts, threaded bolts and rods, and internally threaded grooves. In order to alter the size of the canvas stretcher, the artist must add or remove components or manipulate the heavy, complicated mechanical journey between each component. The instant invention provides a simpler, lighter, and more economical means of adjustment requiring only a simple straight cut of the straight section 11.

The degree to which the size of the prior art canvas stretchers may be adjusted is inherently limited by the size of the components which make up the canvas stretcher. The user is limited to incremental alterations which are defined by the size of the components comprising the prior art devices. The size of the instant invention may be altered with more flexibility. The user may adjust the length of the straight section 11 by nearly infinitely small increments.

Another advantage of the present invention is the minimization of the areas of the canvas stretcher that make contact with the canvas. In conventionally known canvas stretchers, the canvas is stretched directly over the face of the canvas stretcher. This results in a relatively large area of canvas in intimate contact with the material of the canvas stretcher. It has been found that over time this contact causes deterioration of the canvas. This is particularly true for conventional canvas stretchers which are made of wood, because of the resins and acids which may be released by the wood. As seen in FIG. 5, the instant invention minimizes this problem by having a relatively thin straight section raised surface 28 on the straight section upper surface 27 of the canvas stretcher which minimizes the canvas's contact with the canvas stretcher. A similar fixed corner raised surface 44 is also formed on the fixed corner sections 10 so that the canvas is raised off the canvas stretcher over the entire perimeter.

The canvas stretcher of this invention also alleviates the canvas deterioration problem because it may advantageously be easily constructed of a synthetic product or plastic, such as high impact polystyrene, polyethylene, or PVC. Conventional canvas stretchers are constructed from wood. It is known that acid migration from the wood into the canvas causes deterioration of the canvas. Constructing a canvas stretcher from a synthetic product or plastic may reduce or eliminate this problem. It is possible to formulate a synthetic product which is acid free creating an acid free canvas stretching device which is greatly desired by the industry. The use of a synthetic or plastic material is particularly appropriate here as the simple structural elements of this invention are amenable to extrusion or molding type manufacturing techniques. Ease of construction using plastic is a further advantage considering the increased cost of and environmental concerns relating to the traditional use of wood in canvas stretcher construction. Similarly, the use of molding or extrusion-type construction techniques eliminates the finishing steps required in wood construction to form the notch 16 and circular aperture 17 in the straight section 11. Use of plastic as a construction material does not affect the ease with which the user may cut the straight sections 11 easily to create a canvas stretcher of the desired size.

The notch 16 formed continuously in the straight section 11 is not only formed to receive the rectangular peg 13 of the fixed corner section 10, it is also configured to receive the optional long and butting bracing members 14, 15 in a way that keeps the optional long and butting bracing members 14, 15 from extending beyond the back of the canvas stretcher. These optional long and butting bracing members 14, 15 may be used to counteract the inward forces exerted on the canvas stretcher by the taut canvas that would otherwise warp the straight sections 11 of the canvas stretcher. Conventional bracing elements are ordinarily tacked onto the back of the canvas stretcher creating a canvas stretcher which cannot be hung flush against a wall. The instant invention allows the optional long and butting bracing members 14, 15 to be inserted into the interior notch 16 formed on the straight section interior surface 25 of the straight sections 11 such that they do not protrude from the back of the canvas stretcher. The optional long and butting bracing members 14, 15 may be affixed to the straight sections using a fastener 18.

This invention further contemplates a cross bracing member 20 placed at the intersection of the optional long and butting bracing members 14, 15. As shown in FIG. 1, this cross bracing member 20 allows the long bracing member 14 to span the entire length or width of the canvas stretcher while the butting bracing member 15 which is perpendicular to the long bracing member 14 is bisected into two sections which butt against the long bracing member 14. FIG. 13 shows how the cross bracing member 20 is affixed to the optional long and butting bracing members 14, 15 using one or more fasteners 18. Specifically, FIG. 13 shows that in one embodiment of this invention four optional butting bracing members 15 may be used. The cross bracing member 20 is affixed to the optional bracing members 14, 15 in the same manner if four butting bracing members 15 are used or if a long bracing member 14 and two butting bracing members 15 are used.

The cross bracing member 20 improves the strength and rigidity of the canvas stretcher while also allowing the use of optional long and butting bracing members 14, 15 that are flush with the body of the canvas stretcher. The cross bracing member 20 allows the butting bracing member 15 to butt against the long bracing member 14. Otherwise, one bracing member would have to ride over the top of the perpendicular bracing member creating a profile which extends beyond the main body of the canvas-stretcher.

From the description above, it will be seen that the present invention provides a unique canvas stretcher. The canvas stretcher is composed of a small number of simply designed elements which represent a real advance over the prior art. The fixed corner sections 10 ensure the squareness of the canvas stretcher throughout the canvas stretching process. The straight sections 11 with a notch 16 on the straight section interior surface 25 and circular aperture 17 formed along and through the entire length, or a substantial length, of the straight section 11 provides the user with the ability to alter the canvas stretcher by making a single, simple straight cut. The straight section raised surface 28 and fixed corner raised surface 44 provide clearance for the canvas to minimize deterioration. Finally, the optional long and butting bracing members 14, 15 allow the final work of art to be hung flush against a wall.

While particularly preferred embodiments have been shown, it should be expressly understood that such embodiments have been given for illustrative purposes only and are not intended to limit the scope of the present invention as further defined by the appended claims. For example, the fixed corner sections 10 discussed above are fixed at 90° angles and thereby limiting the canvas stretcher to square or rectangular shapes. Fixed comers having different angles may be used without departing from the underlying concept of the invention. Similarly, the embodiment discussed above relates a notch 16 and circular aperture 17 configured to receive the rectangular peg 13 and circular dowel 12, respectively. These elements need not be rectangular or circular. Other shapes may be used without departing from the underlying concept of the invention.

Figure 14:
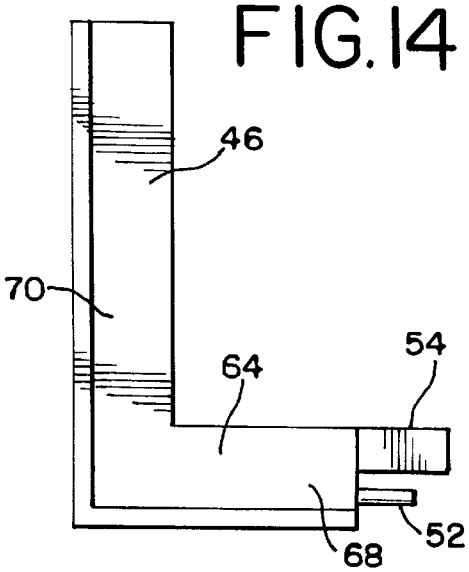
FIG. 14 is a front elevation of the extended fixed corner sections of one embodiment of the invention.
Figure 15:
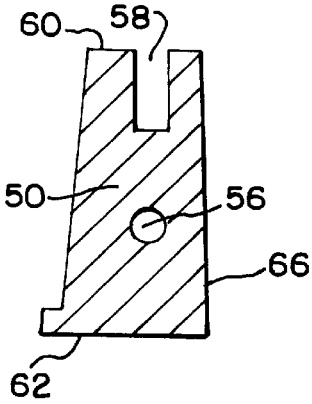
FIG. 15 is a cross sectional view of the extended fixed corner sections of one embodiment of the invention.
Figure 16:
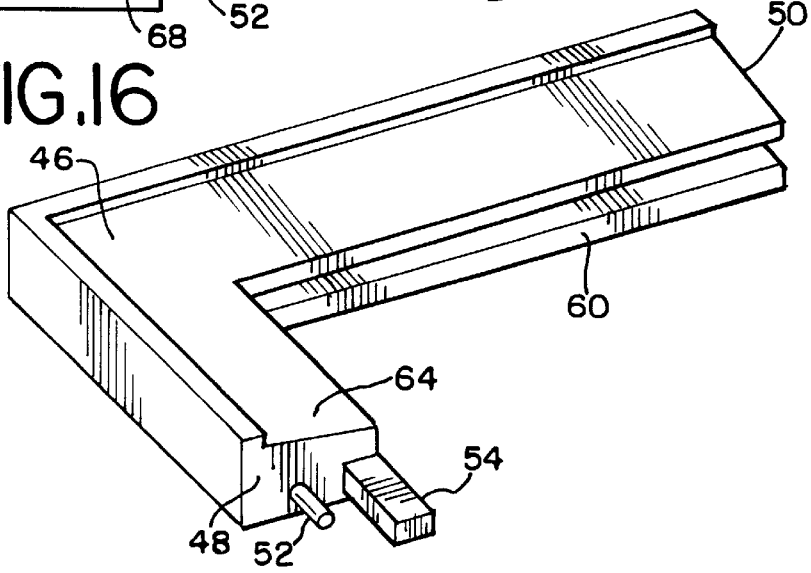
FIG. 16 is a perspective view of the extended fixed corner sections of one embodiment of the invention.

FIGS. 14, 15 and 16 illustrate a further alternative embodiment of the present invention having extended fixed corner sections 46. The extended fixed corner sections 46 have a shorter leg 68 terminating in a first shorter end surface 48 and a longer leg 70 terminating in a second longer end surface 50 as well as a longer leg interior surface 60, extended fixed corner exterior surface 62, extended fixed corner upper surface 64 and extended fixed corner lower surface 66. The resulting extended fixed corner section is substantially "L" shaped in this embodiment. The first shorter end surface 48 has formed on it a plurality of protrusions which may include a shorter leg circular dowel 52 and a shorter leg rectangular peg or tenon 54. The second longer end surface 50 and the longer leg interior surface have formed in them a plurality of cavities which may include a longer leg circular aperture 56 and a longer leg notch or mortise 58. The longer leg circular aperture 56 and longer leg notch 58 are configured in a way to receive the shorter leg circular dowel 52 and shorter leg rectangular peg 54. It is apparent that for a rectangular construction a four piece construction may be used and the size of the frame, adjusted in a manner analogous to the other embodiments described which have separate fixed corner sections 10 and straight sections 11. This embodiment does not depart from the underlying principles of the instant invention.

What is claimed is:

1. A canvas stretching and framing device comprising:

a plurality of extended fixed corner sections further comprising:

(a) an extended fixed corner upper surface;

(b) an extended fixed corner lower surface;

(c) an extended fixed corner exterior surface;

(d) a shorter leg terminating in a first shorter end surface, (e) a longer leg terminating in a second longer end surface; and (f) a longer leg interior surface said shorter leg and said longer leg resulting in the extended fixed corner sections having a substantially L-shaped configuration; said extended fixed corner sections when engaged with other extended fixed corner sections forming the periphery of the canvas stretching and framing device.

2. The canvas stretching and framing device of claim 1 wherein said first shorter end surface on one of said extended fixed corner sections engages the second longer end surface of another said extended fixed corner section frictionally.

3. The canvas stretching and framing device of claim 1 wherein said extended fixed corner sections further comprise a plurality of protrusions from said first shorter end surface; and said extended fixed corner sections further comprise a plurality of cavities located on said second longer end surface and said longer leg interior surface, said cavities having walls frictionally engageable with said protrusions formed on said first shorter end surface.

4. The canvas stretching and framing device of claim 1 wherein at least one of said protrusions on each of said extended corner sections comprises a shorter leg tenon and at least one of said cavities on each said extended corner section comprises a longer leg mortise.

5. The canvas stretching and framing device of claim 1 further comprising a means for adjusting the spacing of the engagement between the extended fixed corner sections.

6. The canvas stretching and framing device of claim 1 further comprising a plurality of bracing members engageable with said extended corner interior surfaces of said extended fixed corner sections.

7. The canvas stretching and framing device of claim 1 further comprising one or more fasteners drivable through one or more of the extended fixed corner sections for engagement with one or more of said protrusions from one or more of said extended fixed corner sections.

8. The canvas and stretching and framing device of claim 1 wherein said extended corner sections are made from a plastic.

* * * * *

UNITED STATES PATENT AND TRADEMARK OFFICE

CERTIFICATE OF CORRECTION

PATENT NO. : 6,253,471 B1
DATED : July 3, 2001
INVENTOR(S) : Craig H. Straub

It is certified that error appears in the above-identified patent and that said Letters Patent is hereby corrected as shown below:

Title page,
Correct the name of the Inventor to read -- Craig H. Straub --.

Column 6,
Line 7, please delete the word "comers" and insert -- therefore -- corners --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*